United States Patent [19]

Windgassen et al.

[11] Patent Number: 4,605,507

[45] Date of Patent: Aug. 12, 1986

[54] PROCESSES FOR MAKING A SULFUR SUSPENSION AND A SULFURIZED CUTTING FLUID

[75] Inventors: Richard J. Windgassen, Wheaton; J. Andrew Waynick, Bolingbrook, both of Ill.

[73] Assignee: Standard Oil Company (Indiana), Chicago, Ill.

[21] Appl. No.: 733,851

[22] Filed: May 13, 1985

Related U.S. Application Data

[63] Continuation of Ser. No. 553,199, Nov. 18, 1983.

[51] Int. Cl.[4] ..... C10M 135/02

[52] U.S. Cl. ..... 252/45; 252/31; 252/24

[58] Field of Search ..... 252/31, 24, 45

[56] References Cited

U.S. PATENT DOCUMENTS

| | | | |
|---|---|---|---|
| 2,151,585 | 3/1939 | Buxbaum | 252/31 |
| 2,829,101 | 4/1958 | Rinse | 252/31 |
| 3,972,853 | 8/1976 | Gorring et al. | 252/45 |

*Primary Examiner*—Jacqueline V. Howard

*Attorney, Agent, or Firm*—William H. Magidson; James L. Wilson; Philip Hill

[57] ABSTRACT

There are provided a process for preparing a suspension of elemental sulfur in a fluid, a process for preparing a sulfurized cutting fluid, and products that are obtained from the processes. A high-shearing mechanical device is employed in either process to transform an unfinished suspension of sulfur in a fluid into a stable suspension of finely-divided sulfur.

28 Claims, No Drawings

PROCESSES FOR MAKING A SULFUR SUSPENSION AND A SULFURIZED CUTTING FLUID

CROSS REFERENCE TO RELATED APPLICATION

This application is a continuation application of copending application U.S. Ser. No. 553,199, filed on Nov. 18, 1983.

BACKGROUND OF THE INVENTION

This invention is directed to lubricating fluids that contain elemental sulfur. More particularly, it is directed to the preparation of cutting fluids containing elemental sulfur and to stable sulfur suspensions that are employed in said cutting fluids.

It is well known that elemental sulfur may be added to various lubricating oils and that such sulfur provides the oil with high-load carrying and antiwear properties. Elemental sulfur is quite beneficial in cutting oils, which are used in the machining, cutting, and forming of metals and metal parts. The sulfur provides a smoother surface finish to the metal being worked upon and extends the life of the cutting tools that are being used to machine the metal parts.

While it is conceivable that one or more sulfur compounds other than elemental sulfur could be used to provide the same sort of antiwear and lubricative properties, the use of elemental sulfur results in a lower cost. In addition, active sulfur compounds usually furnish a chemical activity of sulfur which is less than that of elemental sulfur.

In U.S. Pat. No. 3,309,315, Tarazi, et al., treated a naphthenic base crude oil with a moderate sulfuric acid treatment, which treatment enabled the remaining unsaturated components of the oil to be more susceptible to a subsequent reaction with certain sulfur compounds so as to form beneficial, solution-stable, sulfur-bearing, organic compounds in the oil. In U.S. Pat. No. 3,252,908, Coleman considered an oil-soluble additive composition comprising about 5 wt% to about 90 wt% of an oil-soluble acylated amine, about 90 wt% to about 5 wt% of a phosphatide, and about 0.01 wt% to about 48 wt% of a mineral oil, which composition stabilizes the suspension of elemental sulfur in a lubricating oil. In U.S. Pat. No. 4,073,736, Schick, et al., employed an antiwear amount of polypropylene glycol and sulfur, and a solubility improving amount of a monohydric alcohol having from 5 to 30 carbon atoms, which lubricant additive is especially useful in metal working and cutting applications.

The solubility of elemental sulfur in a base oil is approximately 0.5 wt%. Hence, many cutting oils are made by dissolving up to 0.5 wt% sulfur in the base oil. Molten sulfur can be used and is pumped directly into the oil, but at a temperature of about 116° C. (240° F.) to 121° C. (250° F.), the temperature range that includes the melting point of sulfur. The oil must be heated to this temperature when the molten sulfur is introduced into it. If the temperature of the oil were below the melting point of sulfur, agglomerates of solid sulfur would form before the molten sulfur was able to be fully dissolved in and dispersed throughout the oil. Since large sulfur particles dissolve very slowly, the addition of molten sulfur to a base oil at a temperature much below 116° C. (240° F.) is not feasible on a commercial basis. For a like reason, the addition of solid sulfur to the base oil at such a temperature would not be feasible on a commercial basis.

There have now been found a process for preparing a stable sulfur suspension and a process for preparing a sulfurized cutting fluid in which elemental sulfur can be effectively added to the cutting fluid at a temperature as low as 54° C. (130° F.), or even lower. The process for preparing the sulfur suspension permits sulfur to be added to a suspending medium at room temperature, while the process for preparing a sulfurized cutting fluid permits the sulfur to be introduced into the fluid at temperatures that are as low as 54° C. (130° F.), or even lower, and to dissolve rapidly into the fluid without the formation of a significant amount of solid sulfur agglomerates.

SUMMARY OF THE INVENTION

Broadly, according to the present invention, there is provided a process for preparing a suspension of finely-divided sulfur in a fluid, which process comprises: (1) blending a base oil and a thickener in a mixing apparatus to form a suspending medium of an oil-thickener blend or blending a base oil and a lubricating grease in a mixing apparatus to form a suspending medium of an oil-grease blend, said base oil being either a mineral lubricating oil or a synthetic lubricating fluid; (2) introducing elemental sulfur into said suspending medium while continually agitating said suspending medium to form an unfinished suspension of sulfur in said suspending medium, the amount of sulfur that is added being sufficient to provide a suspension containing up to about 70 wt% sulfur; and (3) homogenizing said unfinished suspension of sulfur in a high-shearing mechanical device to provide a suspension of finely-divided sulfur. Examples of the high-shearing mechanical device are a pressure relief valve and a combination of a gear pump and a pressure relief valve.

There is also provided a process for preparing a sulfurized cutting fluid, which process comprises adding with continual agitation the above suspension of finely-divided sulfur in oil to a base oil having a viscosity that is appropriate for a cutting fluid to provide a sulfurized cutting fluid.

In addition there are provided the products that can be obtained from the above processes.

DESCRIPTION AND PREFERRED EMBODIMENTS

The present invention permits elemental sulfur to be introduced into a lubricating fluid, particularly a cutting fluid, at temperatures that are as low as 54° C. (130° F.), or even lower, and to dissolve effectively in the lubricating fluid. This is accomplished by placing the elemental sulfur in a suspending agent or suspending medium which is relatively oil-soluble at the concentration at which it will be present in the final cutting fluid and passing the suspending agent or suspending medium containing the free sulfur through a homogenization device. The resulting homogenized suspension can then be added to the cutting fluid to provide a sulfurized cutting fluid. The suspending agent or suspending medium is conveniently either a mixture of a base oil and a thickener or a mixture of a base oil and a lubricating grease. Preferably, the base oil that is used in making the suspension is the same as the base oil that is to be sulfurized. However, any base oil which is miscible with the base oil of the cutting fluid can be used to make the sulfur suspension.

The base oil of the cutting fluid may have whatever viscosity is convenient. A viscosity that is within the range of about 35 S.U.S. @ 100° F. (7 cSt. @ 40° C.) to about 280 S.U.S. @ 100° F. (53 cSt. @ 40° C.), or greater, is typical. Preferably, the viscosity can be within the range of about 95 S.U.S. @ 100° F. (17 cSt. @ 40° C.) to about 175 S.U.S. @ 100° F. (35 cSt. @ 40° C.).

While any viscosity oil can be used as the base oil in the suspending medium, base oils having viscosities similar to those defined hereinabove for the oils employed as cutting oils are suitable.

The base oil that is used in the suspending medium, as well as the base oil of the cutting fluid, can be either a mineral lubricating oil or a synthetic lubricating fluid, such as an oligomer of an alpha-olefin. However, the base oil of the suspending medium and the base oil of the cutting fluid must be miscible with one another.

The thickener to be employed in the present invention, if used, can be any material which crystallizes or agglomerates into a 3-dimensional network which will restrict the mobility of the fluid. For example, a suitable thickener can be selected from sodium, calcium, lithium, aluminum, barium, or strontium soaps, clays, silica, or polyurea. The thickener must be sufficiently stable in the finished cutting oil to prevent precipitation problems.

If a lubricating grease, rather than a thickener, is to be used in the suspending medium, it is a grease having a National Lubricating Grease Institute (NLGI) consistency of 00 or 000. The softer the grease is, the less the oil that will be required to bring the thickness of the suspending medium to a desirable point. As used herein, the term "thickness" refers to the extent to which the microstructure of the grease thickener in the suspension is able to prevent sulfur particle reagglomeration. For stable sulfur suspensions made with a given grease or thickener, this thickness will be directly related to the ratio of grease to oil, with more grease giving both thicker suspensions and more viscous suspensions. However, the detailed relation between grease to oil ratio and suspension thickness in general will depend on the grease or thickener used. It is to be pointed out, however, that, if a grease is used, a grease of any NLGI consistency is applicable, i.e., 6 to 000. Consequently, the lubricating grease need not be an expensive complex grease. The grease can be a silica-thickened grease; a metal fatty soap grease, such as a sodium, calcium, lithium, aluminum, barium, or strontium soap grease; a clay-thickened grease; or a polyurea-thickened grease. The only criterion for the grease is that the thickener be sufficiently stable in the finished cutting oil to prevent precipitation problems.

The suspending medium, that is, a blend of thickener and oil or a blend of grease and oil, should have a consistency that is thin enough to be pumpable with petroleum refinery equipment and still be thick enough to give a reasonable physical stability to the sulfur suspension. For the formation of the suspending medium, the weight ratio of the lubricating grease to the base oil should be greater than 1 part grease to 10 parts oil. Typically, the weight ratio of the lubricating grease to the base oil will fall within the range of about 1 part grease to 4 parts oil to about 1 part grease to 2 parts oil. Preferably, the weight ratio will be within the range of about 1 part grease to 3 parts oil to 1 part grease to 2 parts oil. The optimum ratio of grease to oil will vary, depending on the particular grease used.

In order to provide the same consistency of suspending medium when using a blend of thickener and base oil, the thickener should be present in the suspending medium in an amount that is greater than about 0.7 wt%. Typically, the thickener should be present in an amount within the range of about 1.6 wt% to about 4 wt%. Preferably, the thickener should be present in an amount within the range of about 2 wt% to about 4 wt%. The optimum concentration of thickener will vary, depending on the thickener used.

While it is possible for the introduction of components into the blend of the sulfur suspension to be carried out in any sequence, the sulfur suspension is best prepared by first obtaining the suspending medium and then mixing the sulfur into the suspending medium. Although heating is not necessary when preparing a suspending medium of grease and base oil, heating of a mixture of thickener and base oil may be required to form a thickener-oil blend. The mixture of thickener and base oil is generally heated at a temperature ranging from room temperature to about 232° C. (450° F.), depending upon the type of thickener used. The most effective blending temperatures for a particular thickener will correspond to the temperature range that is used to make grease thickened by that particular thickener. This information is well known to those skilled in the art.

The mixture of thickener and base oil should be mixed at the appropriate temperature until no solid thickener particles are visible, until the mixture is homogeneously translucent, and until the mixture is of uniform consistency. Any mixture of chemicals, which when heated in the base oil react to form an applicable thickener, is also applicable in this process of forming an oil-thickener suspending medium. Such a mixture of chemicals is considered equivalent to the thickener which they will react to form.

If a grease-oil suspending medium is made, the temperature of mixing should be between room temperature and 232° C. (450° F.). Typically, it will be between room temperature and 54° C. (130° F.). Preferably, it will be room temperature. The time required for mixing the grease-oil suspending medium will be between 1 min and 1 hr, or longer, depending on the suspending medium batch size and the efficiency of the mixing apparatus used. Generally, smaller batch sizes and higher-efficiency mixers result in shorter mixing times. As a general rule, the mixing of the grease-oil suspending medium is complete when the degree of homogeneity of the grease-oil suspending medium reaches an unchanging level.

The base oil and the thickener or the base oil and the lubricating grease can be mixed in any mixing apparatus. A rotary-type mixing apparatus is preferred. The elemental sulfur can then be added into the resulting suspending medium accompanied by continuous agitation to form an unfinished suspension of the sulfur. The term "unfinished suspension" as used herein refers to a mixture of sulfur and suspending medium wherein the sulfur particles are sufficiently large to prevent the uniform dispersion throughout and rapid dissolving of the sulfur in the cutting fluid, when the suspension is added to the cutting fluid. Elemental sulfur can be introduced into the suspending medium at a temperature ranging from room temperature to about 121° C. (250° F.). Typically, it is added at a temperature within the range of room temperature to about 54° C. (130° F.). Preferably, elemental sulfur is added to the suspending medium at room temperature. The time required to mix the sulfur into the suspending medium to form the unfinished suspension will be between 1 min and 1 hr, or longer, depending on the unfinished-suspension batch size and the efficiency of the mixing apparatus used. Generally, smaller batch sizes and higher-efficiency mixers result in shorter mixing times. As a general rule, the mixing of the unfinished suspension is complete when the degree of homogeneity of the unfinished suspension reaches an unchanging level.

The finely-divided sulfur suspension can then be made by passing the unfinished sulfur suspension through any high-shearing mechanical device, such as a gear pump, a pressure relief valve, or a combination of a gear pump and a pressure relief valve. Any other device which provides a similar high-shearing action would work equally well. Moreover, any mixing device which also provides such high-shearing action can be used in lieu of a blending device to effect preparation of the sulfur suspension in one step. Whatever the high-shearing mechanical device is, it should be adequate to shear the particle size of the elemental sulfur down to a size small enough to effect rapid dissolving of the sulfur when added to the base oil at a temperature as low as 54° C. (130° F.) to 60° C. (140° F.), or lower. In fact, the sulfur can be dissolved in the base oil at a temperature within the range of about room temperature to about 121° C. (250° F.); typically within the range of room temperature to about 54° C. (130° F.); and preferably within the range of about 49° C. (120° F.) to about 54° C. (130° F.). A finely-divided sulfur is required in the stable sulfur suspension. While one pass through the high-shearing device should do an acceptable job of providing a finely-divided sulfur suspension, it is preferred that a second and possibly a third pass through the high-shearing device be made in order to assure optimum breakup of the sulfur particles. The temperature of the unfinished suspension during the homogenization can be between room temperature and 121° C. (250° F.). Typically, it is between room temperature and 54° C. (130° F.). Preferably, it is room temperature. The finely-divided sulfur suspension can then be used suitably to effect a rapid, easy dissolving of sulfur in the cutting fluid.

It is contemplated that the sulfur suspension can contain any amount of sulfur up to about 70 wt%, based upon the weight of the suspension. Typically, the suspension can contain any amount of sulfur up to about 40 wt%. While the sulfur could be present in an amount as low as 1 wt%, preferably, it will be present in an amount within the range of about 10 wt% to about 40 wt%.

It is to be noted that the sulfur suspension prepared according to the present invention is not indefinitely stable and will begin to settle slowly, if the suspension is allowed to stand for a period of 3 to 4 hours. Advantageously, the finely-divided sulfur particles prepared by the method of the present invention only become more densely suspended and do not agglomerate to form the very large agglomerates of sulfur considered hereinabove. If such gentle settling does occur, rotary agitation alone is sufficiently effective to bring the suspension back to optimum continuity, if the time of settling is less than a few weeks. It is preferred that treatment with the high-shearing mechanical device be employed, if longer settling times have occurred.

The stable sulfur suspension described hereinabove can be used conveniently in the preparation of a sulfurized cutting fluid, which cutting fluid comprises a major portion of a base oil and a minor portion of the stable sulfur suspension comprising a base oil, a thickener or lubricating grease, and finely-divided elemental sulfur, a sufficient amount of sulfur being introduced into the cutting oil to provide a fluid that will improve the surface finish of the metal being machined, extend the life of the cutting tool, and increase the lubricity of the fluid. If other additives, such as sulfurized fatty oils, sulfurized olefins, chlorinated fatty oils, chlorinated paraffins, sulfochlorinated fatty oils, sulfochlorinated hydrocarbons, fatty oils, or other antiwear additives such as metal dithiophosphates, metal dithiocarbamates, and the like, are desired in the finished cutting oil, they may be added either before or after the dissolving of elemental sulfur, such dissolving of the elemental sulfur being accomplished by use of the stable sulfur suspension of the present invention.

The solubility of the finely-divided sulfur particles in the cutting fluid can reach about 0.5 wt% sulfur, based on the weight of the composition. This maximum amount can be raised slightly if the cutting fluid contains other additives, such as a sulfurized fatty oil, a chlorinated paraffin or chlorinated fatty oil, and/or a sulfurized olefin.

In a typical cutting fluid, the base oil makes up about 85 to 95 wt% of the cutting fluid.

Broadly, according to the present invention, there is provided a process for preparing a suspension of finely-divided sulfur in a fluid, which process comprises (1) blending a base oil and a thickener in a mixing apparatus to form a suspending medium of an oil-thickener blend or blending a base oil and a lubricating grease in a mixing apparatus to form a suspending medium of an oil-grease blend, said base oil being either a mineral lubricating oil or a synthetic lubricating fluid; (2) introducing elemental sulfur into said suspending medium while continually agitating said suspending medium to form an unfinished suspension of sulfur in said suspending medium, the amount of sulfur that is added being sufficient to provide a suspension containing up to about 70 wt% sulfur; and (3) homogenizing said unfinished suspension of sulfur in a high-shearing mechanical device to provide a suspension of finely-divided sulfur. As previously stated, any mixing device or procedure which both mixes and provides sufficient shearing forces can be used to prepare the suspension in a single step.

According to the present invention there is also provided a process for preparing a sulfurized cutting fluid, which process comprises: (1) blending a base oil and a thickener in a mixing apparatus to form a suspending medium of an oil-thickener blend or blending a base oil and a lubricating grease in a mixing apparatus to form a suspending medium of an oil-grease blend, said base oil being either a mineral lubricating oil or a synthetic lubricating fluid; (2) introducing elemental sulfur into said suspending medium while continually agitating said suspending medium to form an unfinished suspension of sulfur in said suspending medium, the amount of sulfur that is added being sufficient to provide a suspension containing up to about 70 wt% sulfur; (3) passing said unfinished suspension of sulfur through a high-shearing mechanical device to provide a suspension of finely-divided sulfur; and (4) then adding with continual agitation said suspension of finely-divided sulfur to a base oil having the viscosity that is suitable for a cutting fluid to provide said sulfurized cutting fluid.

There are also provided the products that are obtained from the above processes.

The following examples are presented for the purpose of illustration only and are not intended to limit the scope of the present invention.

EXAMPLE I

Three samples of a stable suspension of elemental sulfur in a mixture of base oil and lubricating grease were prepared in the laboratory. Each of the suspensions was made with a mineral oil having an average viscosity of 95 S.U.S. @ 100° F. (17 cSt. @ 40° C.), which oil had been obtained from Amoco Oil Company. Triangle brand powdered sulfur having a particle size such that 60 wt% to 80 wt% will pass through a 200-mesh screen (U.S. Sieve Series) was used in each. The grease for each suspension was a simple calcium soap grease that contained no additives and had an NLGI consistency of 00.

Three different grease-to-oil weight ratios were studied, namely 1:1, 1:2, and 1:3. Sufficient sulfur was added to each suspension to provide a level of 40 wt% sulfur.

In each case, the base oil and grease were premixed at room temperature with a small rotary blender and this was followed by the addition of elemental sulfur at room temperature. Once the unfinished sulfur suspension had been prepared, it was sheared through a hand-pumped homogenizer, said homogenizer working on the same principle as a pressure relief valve. The finished stable sulfur suspension was thus obtained. A vial of base oil, also 95 S.U.S. @ 100° F. (17 cSt. @ 40° F.), was heated to 54° C. (130° F.) and the stable sulfur suspension was added to said oil in a quantity sufficient to add 0.5 wt% of elemental sulfur to said oil. The vial contents were then shaken vigorously for several minutes. The elemental sulfur completely dissolved in the oil; no trace of undissolved elemental sulfur remained.

Although all three stable sulfur suspensions effected rapid and complete solubilization of elemental sulfur in the base oil, the 1:3 ratio suspension was judged superior due to its lower viscosity and easier pumpability. The composition of the sulfur suspension obtained with the 1:3 grease-oil blend was as follows: 45 wt% base oil, 15 wt% calcium soap grease having an NLGI consistency of 00, and 40 wt% powdered sulfur.

EXAMPLE II

A larger batch of a stable sulfur suspension employing a 1:3 grease-oil blend was prepared. The ingredients and temperatures employed in the preparation of this stable sulfur suspension were the same as those employed in Example I. Sufficient base oil and grease were added to a 5-gal container to provide approximately 3 gal of grease-oil blend. The blend was prepared by premixing the oil and grease in the container by means of a hand-held rotary blender at room temperature. This premixing was conducted for a period of approximately 5 minutes. Then sufficient powdered sulfur was added gradually to the grease-oil blend while the hand-held rotary blender was employed to continually agitate the contents of the 5-gal container. The resulting mixture was then cycled through a high-shearing Viking gear pump, Model FH432, which was equipped with a motor from General Electric Company, which motor was rated at one-half horsepower and was operated at 1,725 rpm. The resulting sulfur suspension still had some small but visible agglomerates of sulfur.

A pressure relief valve, rated at 50 psig, was installed at the pump exit. Such pressure relief valve was employed to simulate the action of the hand homogenizer of Example I.

A second batch of sulfur suspension was prepared and this suspension was then passed through the gear pump having its exit connected to the pressure relief valve. The sulfur suspension that was obtained appeared to be very smooth and did not have any visible particles of sulfur. The preparation of the sulfur suspension was done entirely at room temperature. The suspension remained stable without apparent change for several hours. Eventually, there appeared some development of an oil layer on top of the suspension. However, this appeared to be only a contraction of the suspension structure and no reagglomeration of sulfur particles was seen. A simple mixing of the suspension was sufficient to restore it to its original form.

The sulfur suspension was added to a base oil in such an amount that the resulting oil contained about 0.5 wt% elemental sulfur. The addition of the suspension to the oil was carried out when the oil was at a temperature of approximately 54° C. (130° F.). As in Example I, all the sulfur dissolved upon vigorous shaking of the vial.

EXAMPLE III

A commercial batch of cutting oil was prepared according to the process of the present invention. The finished oil was prepared to contain 97.2 wt% paraffinic base oil, 0.5 wt% elemental sulfur, 2.0 wt% fatty oil, and 0.1 wt% zinc dialkyldithiophosphate (an antiwear enhancing additive). A blend of the oil and other additives, excluding the elemental sulfur, was mixed at a temperature of 54° C. (130° F.) for about 15 minutes. The base oil used had a fluid viscosity of 95 S.U.S. @ 100° F. A 90 pound (8.3 gal) batch of the stable sulfur suspension had been prepared in the laboratory using the method described in Example II. This was the amount needed to satisfy 0.5 wt% sulfur requirement for the batch of cutting oil being made. That batch size was 1000 gal. The 90 pounds of stable sulfur suspension were added to the blend of other ingredients described above. The temperature was maintained at 54° C. (130° F.) and the entire batch of oil was constantly mixed for 1 hr. Samples were taken every 15 minutes to determine how rapidly the sulfur dissolved. The sample taken after the first 15 minutes indicated that all of the elemental sulfur was dissolved. Hence, the process of the present invention can produce a satisfactory sulfurized cutting oil.

What is claimed is:

1. A process for preparing a suspension of finely-divided sulfur in a fluid, which process comprises: (1) blending a base oil and a thickener in a mixing apparatus to form a suspending medium of an oil-thickener blend or blending a base oil and a lubricating grease in a mixing apparatus to form a suspending medium of an oil-grease blend, said base oil being either a mineral lubricating oil or a synthetic lubricating fluid; (2) introducing elemental sulfur into said suspending medium while continually agitating said suspending medium to form an unfinished suspension of sulfur in said suspending medium, said introducing being carried out for a period of time within the range of 1 minute to 1 hour, the amount of sulfur that is added being sufficient to provide a suspension containing up to about 70 wt% sulfur; and (3) homogenizing said unfinished suspension of sulfur in a high-shearing mechanical device by passing said unfinished suspension of sulfur through said high-shearing mechanical device from one to three times at a temperature within the range of room temperature to 121° C. (250° F.) to provide a suspension of finely-divided sulfur.

2. The process of claim 1, wherein said high-shearing mechanical device is adequate to shear the particle size of the elemental sulfur down to a size small enough to effect rapid dissolving of the sulfur when said suspension of finely divided sulfur is added to a base oil and said suspension of finely-divided sulfur contains sulfur of a particle size that is small enough to effect rapid dissolving of the sulfur when said suspension of finely-divided sulfur is added to a base oil.

3. The product of the process of claim 1.

4. The process of claim 2, wherein the same mechanical apparatus serves as said mixing apparatus and said high-shearing mechanical device.

5. The process of claim 2, wherein a thickener and a base oil are blended to form said suspending medium, said thickener being added per se or being prepared in situ.

6. The process of claim 2, wherein a lubricating grease and a base oil are blended to form said suspending medium.

7. The process of claim 2, wherein said high-shearing mechanical device is a gear pump equipped with a pressure relief valve that provides effective shearing of the sulfur particles into smaller particles.

8. A process for preparing a sulfurized cutting fluid, which process comprises adding with continual agitation the product of claim 3 to a base oil having a viscosity that is suitable for a cutting fluid to provide said sulfurized cutting fluid.

9. The process of claim 5, wherein said suspending medium contains said thickener in an amount that is greater than about 0.7 wt%, said thickener being present in an amount of up to about 4 wt%, based upon the weight of said suspending medium.

10. The process of claim 6, wherein said suspending medium has a weight ratio of grease to oil that is greater than 1 part grease to 10 parts oil.

11. The process of claim 9, wherein said suspending medium contains said thickener in an amount that falls within the range of about 1.6 wt% to about 4 wt%, based upon the weight of said suspending medium, the amount of sulfur that is added is sufficient to provide a suspension containing about 10 wt% to about 40 wt% sulfur, and said high-shearing mechanical device is a gear pump equipped with a pressure relief valve that provides effective shearing of the sulfur particles into smaller particles.

12. The process of claim 10, wherein said suspending medium has a weight ratio of grease to oil that falls within the range of 1 part grease to 4 parts oil to 1 part grease to 2 parts oil, the amount of sulfur that is added is sufficient to provide a suspension containing about 10 wt% to about 40 wt% sulfur, and said high-shearing mechanical device is a gear pump equipped with a pressure relief valve that provides effective shearing of the sulfur particles into smaller particles.

13. The product of the process of claim 11.

14. The product of the process of claim 12.

15. A process for preparing a sulfurized cutting fluid, which process comprises: (1) blending a base oil and a thickener in a mixing apparatus to form a suspending medium of an oil-thickener blend or blending a base oil and a lubricating grease in a mixing apparatus to form a suspending medium of an oil-grease blend, said base oil being either a mineral lubricating oil or a synthetic lubricating fluid; (2) introducing elemental sulfur into said suspending medium while continually agitating said suspending medium to form an unfinished suspension of sulfur in said suspending medium, said introducing being carried out for a period of time within the range of 1 minute to 1 hour, the amount of sulfur that is added being sufficient to provide a suspension containing up to about 70 wt% sulfur; (3) homogenizing said unfinished suspension of sulfur in a high-shearing mechanical device by passing said unfinished suspension of sulfur through said high-shearing mechanical device from one to three times at a temperature within the range of room temperature to 121° C. (250° F.) to provide a suspension of finely-divided sulfur; and (4) then adding with continual agitation said suspension of finely-divided sulfur to a base oil having a viscosity that is suitable for a cutting fluid to provide said sulfurized cutting fluid, the sulfur being present in said sulfurized cutting fluid in a soluble form.

16. The process of claim 15, wherein said high-shearing mechanical device is adequate to shear the particle size of said elemental sulfur down to a size small enough to effect rapid dissolving of the sulfur when said suspension of finely-divided sulfur is added to said base oil having a viscosity that is suitable for a cutting fluid and said suspension of finely-divided sulfur contains sulfur of a particle size that is small enough to effect rapid dissolving of the sulfur when said suspension of finely-divided sulfur is added to said base oil having a viscosity that is suitable for a cutting fluid.

17. The process of claim 15, wherein a sufficient amount of said suspension of finely-divided sulfur is added to said base oil having a viscosity that is suitable for a cutting fluid in step (4) to provide a sulfurized cutting fluid containing up to about 0.5 wt% sulfur, based on the weight of said sulfurized cutting fluid.

18. The process of claim 16, wherein a thickener and a base oil are blended to form said suspending medium, said thickener being added per se or being prepared in situ.

19. The process of claim 16, wherein a lubricating grease and a base oil are blended to form said suspending medium.

20. The process of claim 16, wherein said high-shearing mechanical device is a gear pump equipped with a pressure relief valve that provides effective shearing of the sulfur particles into smaller particles.

21. The process of claim 16, wherein said suspension of finely-divided sulfur is introduced into the base oil that is employed as the cutting fluid at a temperature as low as about 54° C. (130° F.).

22. The process of claim 16, wherein the base oil that is employed to make said suspending medium is the same as the base oil that is employed as the cutting fluid.

23. The process of claim 18, wherein said suspending medium contains said thickener in an amount within the range from about 0.7 wt% to about 4 wt%, based upon the weight of said suspending medium.

24. The process of claim 19, wherein said suspending medium has a weight ratio of grease to oil that is greater than 1 part grease to 10 parts oil.

25. The process of claim 23, wherein said suspension of finely-divided sulfur is introduced into the base oil that is employed as the cutting fluid at a temperature as low as 54° C. (130° F.) and said high-shearing mechanical device is a gear pump equipped with a pressure relief valve that provides effective shearing of the sulfur particles into smaller particles.

26. The process of claim 24, wherein said suspension of finely-divided sulfur is introduced into the base oil that is employed as the cutting fluid at a temperature as low as 54° C. (130° F.) and said high-shearing mechanical device is a gear pump equipped with a pressure relief valve that provides effective shearing of the sulfur particles into smaller particles.

27. The product of the process of claim 25.

28. The product of the process of claim 26.

* * * * *